US008150276B2

(12) United States Patent
Joo et al.

(10) Patent No.: US 8,150,276 B2
(45) Date of Patent: Apr. 3, 2012

(54) IMAGE FORMING APPARATUS TO ADJUST DRIVING RATE OF A SUPPLY UNIT AND CONTROLLING METHOD OF THE SAME

(75) Inventors: Jong-hwa Joo, Seoul (KR); Woo-jung Shim, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 500 days.

(21) Appl. No.: 12/034,893

(22) Filed: Feb. 21, 2008

(65) Prior Publication Data

US 2009/0214229 A1 Aug. 27, 2009

(30) Foreign Application Priority Data

Jun. 29, 2007 (KR) ..... 10-2007-0065069

(51) Int. Cl.
*G03G 15/08* (2006.01)

(52) U.S. Cl. ..... 399/27

(58) Field of Classification Search ..... 399/27, 399/258

See application file for complete search history.

(56) References Cited

U.S. PATENT DOCUMENTS

| | | | | |
|---|---|---|---|---|
| 7,013,096 | B2 * | 3/2006 | Ozawa et al. | 399/58 |
| 7,254,348 | B2 * | 8/2007 | Yahagi | 399/27 |
| 7,400,837 | B2 * | 7/2008 | Koyama | 399/27 |
| 7,440,705 | B2 * | 10/2008 | Hatakeyama | 399/27 |
| 2006/0018673 | A1 * | 1/2006 | Choi | 399/27 |
| 2006/0119895 | A1 | 6/2006 | Takata et al. | |
| 2006/0188273 | A1 | 8/2006 | Takesawa et al. | |
| 2008/0044204 | A1 * | 2/2008 | Inoue | 399/262 |

FOREIGN PATENT DOCUMENTS

| | | | |
|---|---|---|---|
| EP | 1 892 585 | A2 | 2/2008 |
| JP | 60178475 | | 9/1985 |
| JP | 62042164 | A * | 2/1987 |
| JP | 62-189484 | | 8/1987 |
| JP | 01200373 | | 8/1989 |
| JP | 02-008873 | | 1/1990 |
| JP | 06324564 | A * | 11/1994 |
| JP | 08076581 | A * | 3/1996 |
| RU | 2304808 | | 8/2007 |

OTHER PUBLICATIONS

European Search Report issued Oct. 23, 2008 in European Application No. 08153797.9.
Russian Office Action issued Nov. 30, 2009 in RU Application No. 2008126326.
Russian Office Action issued Jul. 28, 2009 in RU Application No. 2008126326/28.
KR Office Action issued Jun. 28, 2011 in KR Patent Application No. 10-2007-0065069.
EP Office Action issued Nov. 21, 2011 in EP Application No. 08 153 797.9.
EP Office Action issued May 26, 2010 in EP Application No. 08 153 797.9.

* cited by examiner

*Primary Examiner* — Quana M Grainger
(74) *Attorney, Agent, or Firm* — Stanzione & Kim, LLP

(57) ABSTRACT

An image forming apparatus, a developing agent container and a controlling method of the same that improves a supply rate of developing agent from a developing agent container to a developing device that provides the developing agent to an image carrier.

17 Claims, 8 Drawing Sheets

IMAGE FORMING APPARATUS TO ADJUST DRIVING RATE OF A SUPPLY UNIT AND CONTROLLING METHOD OF THE SAME

CROSS-REFERENCE TO RELATED APPLICATIONS

This application claims priority from Korean Patent Application No. 10-2007-0065069, filed on Jun. 29, 2007 in the Korean Intellectual Property Office, the disclosure of which is incorporated herein by reference.

BACKGROUND OF THE INVENTION

1. Field of the Invention

Apparatuses and methods consistent with the present general inventive concept relate to an image forming apparatus and a controlling method of the same, and more particularly, to an image forming apparatus in which a developing agent container is configured to supply a developing agent to a developing device and a controlling method of the same.

2. Description of the Related Art

An image forming apparatus allows a visible image formed on an image carrier such as a photoreceptor drum to be formed on a printing medium. A developing device that stores a developing agent may provide the developing agent to the image carrier to form the visible image. The image forming apparatus has various ways to replenish the developing agent in the developing device. For example, a developing agent container that stores a developing agent is mounted in a developing device and provides the developing agent to the developing device.

However, the developing agent may not be stably provided to the developing device. Thus, a flow of the developing agent and a pressure in the developing device become unstable, and the developing agent is not properly provided to the developing device. This interrupts the developing agent from being charged with electricity uniformly, and thus a defective image may be formed on the printing medium.

SUMMARY OF THE INVENTION

The present general inventive concept provides an image forming apparatus to keep substantially uniform an amount of a developing agent that is supplied from a developing agent container to a developing device, a developing agent container, and a controlling method of the same.

Additional aspects and utilities of the present general inventive concept will be set forth in part in the description which follows and, in part, will be obvious from the description, or may be learned by practice of the present general inventive concept.

The foregoing and/or other aspects of the present general inventive concept can be achieved by providing an image forming apparatus comprising a developing device to provide a developing agent to an image carrier, a developing agent container to store the developing agent that comprises a supply unit to provide the stored developing agent to the developing device, a detecting member to detect a remaining amount of the developing agent in the developing agent container, and a controller to change a driving rate of the supply unit when the remaining amount of the developing agent detected by the detecting member is less than a predetermined level.

The controller may increase the driving rate when the remaining amount of the developing agent in the developing agent container is less than the predetermined level.

The controller may increase the driving rate stepwise or gradually as the remaining amount of the developing agent becomes lower.

The driving rate may be a ratio of driving time of the supply unit to a unit time.

The driving rate may be a driving speed of the supply unit.

The foregoing and/or other aspects of the present general inventive concept can also be achieved by providing a controlling method of a supply unit of a developing agent container, the method being applied to an image forming apparatus comprising a developing device to provide a developing agent to an image carrier, and the developing agent container storing the developing agent and comprising the supply unit to provide the developing agent to the developing device, the method comprising detecting a remaining amount of the developing agent in the developing agent container and changing a driving rate of the supply unit when the remaining amount of the developing agent detected by the detecting member is less than a predetermined level.

The changing the driving rate may include increasing the driving rate when the remaining amount of the developing agent is less than the predetermined level.

The increasing the driving rate may include increasing the driving rate stepwise or gradually as a level of the remaining amount of the developing agent becomes lower.

The driving rate may be a ratio of driving time of the supply unit to a unit time.

The driving rate may be a driving speed of the supply unit.

The foregoing and/or other aspects of the present general inventive concept can also be achieved by providing a controlling method of an image forming apparatus which comprises a developing device to provide a developing agent to an image carrier, and a developing agent container which stores the developing agent and comprises a supply unit to provide the developing agent to the developing device, the method comprising detecting a remaining amount of the developing agent in the developing agent container and changing a driving rate of the supply unit when the detected remaining amount of the developing agent is less than a predetermined level.

The changing the driving rate may include increasing the driving rate when the detected remaining amount of the developing agent is less than the predetermined level.

The increasing the driving rate may include increasing the driving rate stepwise or gradually as the detected remaining amount of the developing agent becomes lower.

The driving rate may be a ratio of driving time of the supply unit to a unit time.

The driving rate may be a driving speed of the supply unit.

The foregoing and/or other aspects of the present general inventive concept can also be achieved by providing a controlling method of an image forming apparatus comprising providing a developing agent from a developer unit to an image carrier, storing the developing agent in a developing agent container, and supplying the stored developing agent to the developer unit, wherein the supplying comprises detecting a remaining amount of the developing agent in the developing agent container, and changing a supplying rate of the developing agent from the developing agent container to the developer unit when the detected remaining amount of the developing agent in the developing agent container is less than a predetermined level.

The foregoing and/or other aspects of the present general inventive concept can also be achieved by providing an image forming apparatus comprising a developing device to provide a developing agent to an image carrier to form an image, a developing agent container to store the developing agent and to provide the stored developing agent to the developing device, and a controller to control a supplied amount of the stored developing agent to the developing device to be substantially uniform during a unit time when the stored developing agent is provided to the developing device from the developing agent container.

The foregoing and/or other aspects of the present general inventive concept can also be achieved by providing a developing agent container usable with an image forming apparatus, the container comprising a container casing to contain stored developing agent, a container docking part coupled to the container casing to output the stored developing agent, a detecting member to detect a remaining amount of the stored developing agent in the container casing, and a supply unit to provide the stored developing agent to the container docking part, the supply unit to increase a driving rate when the remaining amount of the stored developing agent in the container casing is less than a prescribed amount.

BRIEF DESCRIPTION OF THE DRAWINGS

The above and/or other aspects and utilities of the present general inventive concept will become apparent and more readily appreciated from the following description of the exemplary embodiments, taken in conjunction with the accompanying drawings, in which.

DETAILED DESCRIPTION OF EMBODIMENTS

Figure 1:
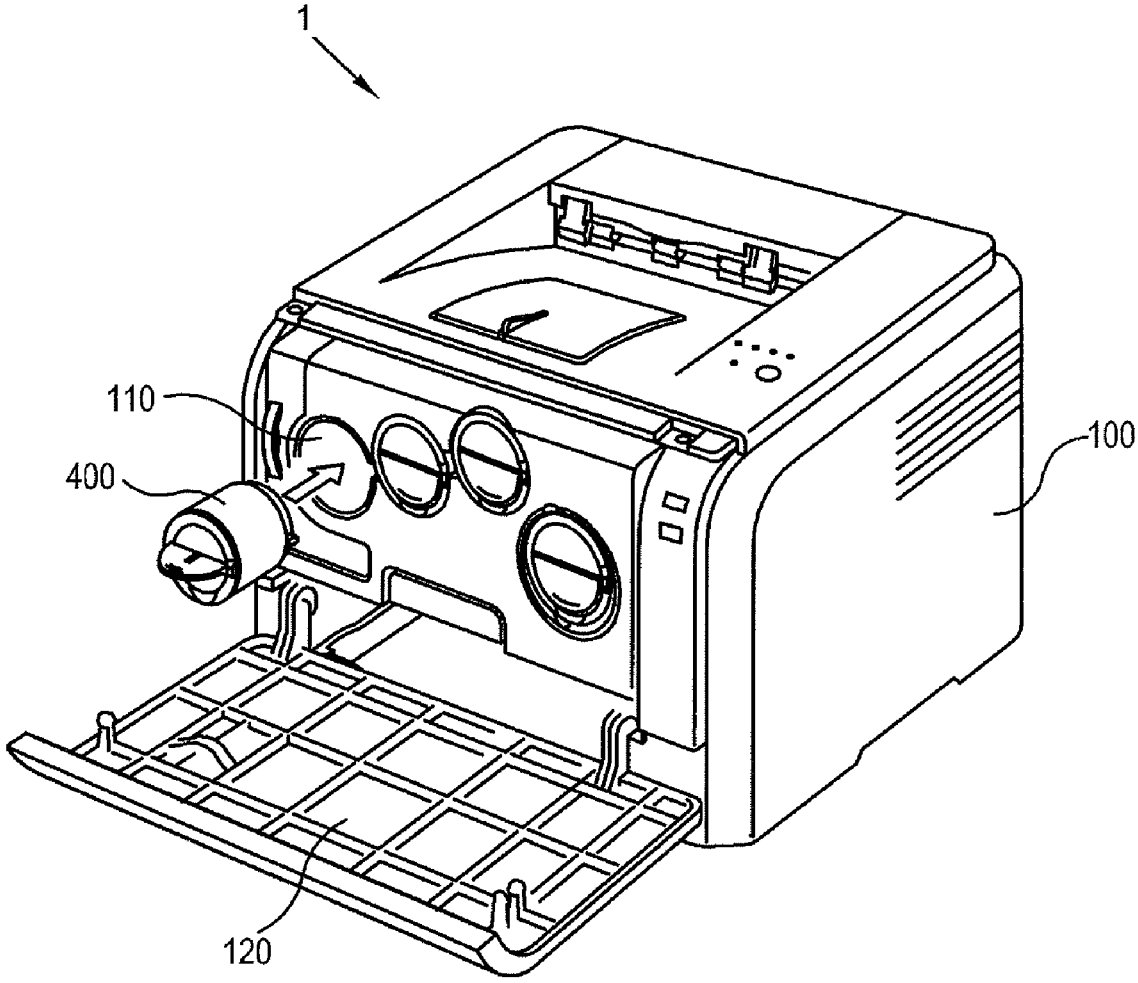
FIG. 1 is a diagram of a perspective view illustrating an image forming apparatus according to an exemplary embodiment of the present general inventive concept.

Reference will now be made in detail to the exemplary embodiments of the present general inventive concept, examples of which are illustrated in the accompanying drawings, wherein like reference numerals refer to like elements throughout. The exemplary embodiments are described below so as to explain the present general inventive concept by referring to the figures.

An image forming apparatus 1 according to an exemplary embodiment of the present general inventive concept may include a plurality of developing devices 300 which correspond to a plurality of colors of developing agents T so as to form a color image on a printing medium. It should be noted that one exemplary developing device 300 and an exemplary developing agent container 400 corresponding thereto will be representatively explained in exemplary embodiments according to the present general inventive concept. However, the other developing devices 300 may also employ exemplary embodiments, which will not be repeatedly described.

Figure 2:
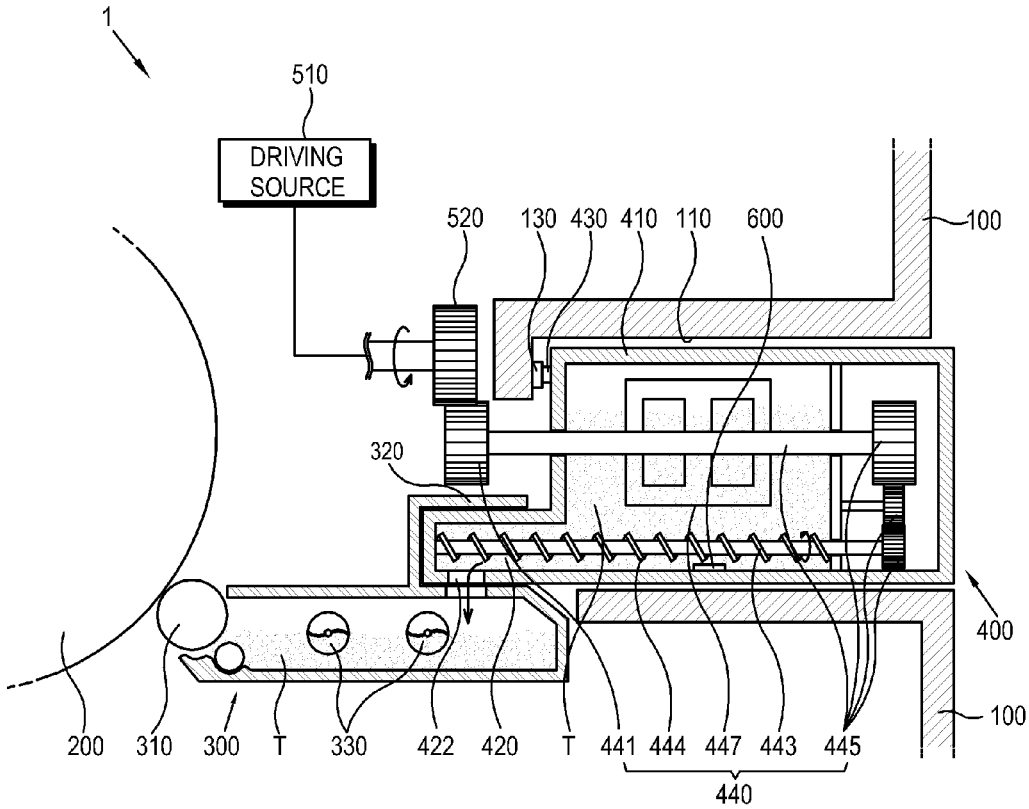
FIG. 2 is a diagram of a cross-sectional view illustrating a main part to illustrate a developing device and a developing agent container in the image forming apparatus according to the exemplary embodiment of the present general inventive concept.
Figure 3:
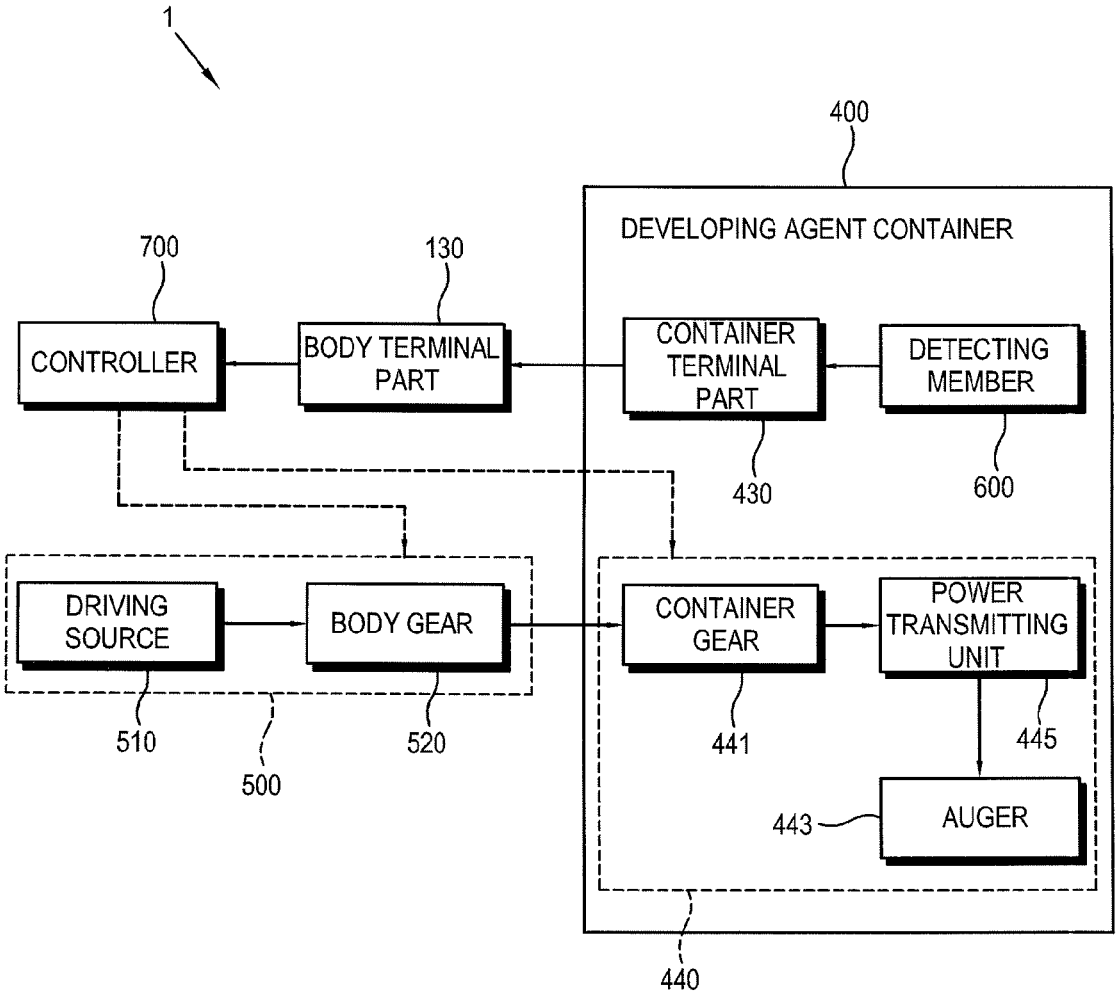
FIG. 3 is a control block diagram illustrating the image forming apparatus according to the exemplary embodiment of the present general inventive concept.

Referring to FIGS. 1 through 3, the image forming apparatus 1 according to an exemplary embodiment of the present general inventive concept may include a body casing 100, an image carrier 200, for example a photoreceptor drum, on which a latent image is formed and the developing device 300 that forms a visible image with a developing agent T on the image carrier 200. The image carrier 200 and the developing device 300 may be provided within the body casing 100.

The image forming apparatus 1 includes a developing agent container 400 that may be permanently or detachably coupled to the body casing 100 to store the developing agent T therein. The developing agent container 400 may include a supply unit 440 that is driven to supply the developing agent T to the developing device 300. The supply unit 440 is preferably provided with a driving power from a body driver 500 installed to the body casing 100.

The image forming apparatus 1 includes a detecting member 600, which is provided within the developing agent container 400, to detect a remaining amount of the developing agent T in the developing agent container 400, and a controller 700 to control driving of the supply unit 440. The controller 700 may change a driving rate of the supply unit 440, and preferably, increase the driving rate of the supply unit 440, if it is determined (e.g., the detecting member 600) that a remaining amount of the developing agent T is less than a predetermined level.

The body casing 100 may include a container accommodator 110 provided in a front surface thereof to accommodate the developing agent container 400, and a front cover 120 to cover the front surface of the body casing 100 including the container accommodator 110.

The container accommodator 110 may extend or communicate from the outside to the inside of the body casing 100. The container accommodator 110 may accommodate the developing agent container 400 to be mounted in the body casing 100 and to supply the developing device 300 with the developing agent stored within the developing agent container 400.

If the developing agent container 400 is accommodated in the container accommodator 110, the developing agent container 400 and the developing device 300 may be coupled with each other to enable the developing agent T to be supplied. Further, for the developing agent T to be supplied as such, the container accommodator 110 may constitute a transmission configuration of driving power from the body driver 500 to the supply unit 440. For example, the container accommodator 110 may constitute a coupling or engaging configuration (e.g., mechanical) of a body gear 520 and a container gear 441 (described later).

The container accommodator 110 may be installed with a body terminal part 130 to contact a container terminal part 430 so that a detection signal of the detecting member 600 can be transmitted to the controller 700. The body terminal part 130 is preferably electrically connected with the controller 700 to transmit the signal from the container terminal part 430 to the controller 700.

A latent image by potential difference may be formed on an external surface of the image carrier 200. The image carrier 200 where the latent image is formed is provided with a developing agent T from the developing device 300 to form a visible image. The visible image may then be transferred from the image carrier 200 to a printing medium.

The developing device 300 provides the developing agent T to the external surface of the image carrier 200 where a latent image is formed. The developing device 300 may store the developing agent T therein and include a developing roller 310 to rotate correspondingly to the image carrier 200 to provide the developing agent T to the image carrier 200.

As the developing device 300 provides the developing agent T to the image carrier 200, the amount of the developing agent T in the developing device 300 decreases. Thus, the developing device 300 needs to be replenished with more of the developing agent T. To this end, the developing agent container 400, which is supportably accommodated in the container accommodating part 110, may be installed to the developing device 300. For example, on the developing device 300 is mounted a container docking part 320 in which the developing agent container 400 may be mounted to communicate with an inside of the developing device 300 so that the developing agent T in the developing agent container 400 may be transported to the developing device 300.

The developing device 300 may include an agitator 330 installed within the developing device 300 where the developing agent T is stored. The agitator 330 (e.g., having a screw shape rotates in parallel with the developing roller 310) may provide the developing agent T to the developing roller 310 and agitate the developing agent T in the developing device 300 to increase fluidity of the developing agent T therein.

A developing agent discharge pipe 420 may be docked in the container docking part 320 when the developing agent container 400 is mounted to the developing device 300. The developing agent T may be discharged from the developing agent discharge pipe 420 via a docking discharge unit 422, and may be provided into the developing device 300 as the supply unit 440 is driven.

The developing agent container 400 stores a developing agent T to be supplied to the developing device 300. The developing agent container 400 is supportably accommodated in the container accommodating part 110, thereby being mounted to the developing device 300, to supply the developing agent T to the developing device 300 by driving the supply unit 440. If the developing agent T stored in the developing agent container 400 is exhausted, the developing agent container 400 may be detached from the container accommodating part 110 and replaced with a new developing agent container 400.

The developing agent container 400 may include a container casing 410 (e.g., having a cylindrical shape), the developing agent discharge pipe 420 installed in a lower front part of the container casing 410 extending along a direction that the developing agent container 400 is mounted to the developing device 300, a container terminal part 430 installed in a front part of the container casing 410, and the supply unit 440. The supply unit 440 may be driven to discharge the developing agent T in the container casing 410 to the outside.

The developing agent discharge pipe 420 may project forward from a front surface to the outside of the container casing 410 and communicate with the inside of the container casing 410. The developing agent discharge pipe 420 is preferably arranged to align or dock with the container docking part 320 provided at one side of the container accommodating part 110 when the developing agent container 400 is supportably accommodated in the container accommodating part 110. Accordingly, a developing agent T in the container casing 410 may be transported by the developing agent discharge pipe 420 and discharged to the developing device 300 when the supply unit 440 is driven.

The container terminal part 430 may contact with the body terminal part 130 when the developing agent container 400 is supportably accommodated (e.g., mounted or loaded) in the container accommodating part 110. The container terminal part 430 is electrically connected to the detecting member 600 to transmit a sensing signal formed in the detecting member 600 to the controller 700.

Further, the container terminal part 430 may store information on characteristics of the developing agent container 400 and transmit the information to the controller 700. The information may include a variety of information, e.g., color information of a developing agent T, originality of the developing agent T, or the like.

The supply unit 440 is preferably installed to the container casing 410 and driven to supply a developing agent T to the developing device 300. The supply unit 440 may be installed to engagingly operate inside and outside the container casing 410, and form a coupling structure with the body driver 500 when the developing agent container 400 is mounted to the body casing 100 and the developing device 300. Accordingly, a driving power is preferably transmitted from the body driver 500 to the supply unit 440 in order to supply the developing agent T.

The supply unit 440 may include the container gear 441 that is installed outside the container casing to interlock with the body gear 520, an auger 443 that is installed inside the container casing 410 where the developing agent T is stored to interlock with the container gear 441, a power transmitting unit 445 to engagingly connect the auger 443 with the container gear 441 so that they interlock with each other, and a container agitator 447. The container agitator 447 may be installed inside the container casing 410 to agitate the developing agent T therein.

The container gear 441 may be disposed in a front center area of the container casing 410 where the developing agent discharge pipe 420 is disposed. The container gear 441 interlocks with the body driver 500, for example the body gear 520, when the developing agent container 400 is mounted to the developing device 300. Thus, the container gear 441 may be driven as the body gear 520 is driven.

The auger 443 is installed within the container casing 410 and provided to transport the developing agent T in the container casing 410 to the developing agent discharge pipe 420. The auger 443 may operate by interlocking with the container gear 441. The auger 443 may have various configurations as long as it is capable of discharging or moving the developing agent T. For example, the auger 443 may be provided as a spiral blade 444 on a shaft that extends from one lower part within the container casing 410 to the developing agent discharge pipe 420, thereby transporting the developing agent T according to rotation of the spiral blade.

The power transmitting unit 445 may be provided as a shaft, a gear, etc. and preferably mechanically connects the container gear 441 and the auger 443. The power transmitting unit 445 transmits a driving power to the auger 443 as the container gear 441 interlocking with the body driver 500 is driven, e.g., rotatably driving the auger 443. The power transmitting unit 445 may be modified variously in configuration as long as it accomplishes its function.

The container agitator 447 is coupled to the power transmitting unit 445 in the container casing 410 and rotates to agitate a developing agent T. The container agitator 447 is provided as a film where a through hole is formed so that the developing agent T is easily transferred. The container agitator 447 may be modified variously in configuration as long as it accomplishes its function.

The body driver 500 is installed in the body casing 100. The body driving 500 may generate a driving power and transmit it to the supply unit 440 if the developing agent container 400 is accommodated in the container accommodating part 110. The body driver 500 includes a driving source 510 that generates a driving power, and the body gear 520 that transmits the driving power from the driving source 510. The body driver 500 may be modified variously in configuration as long as it accomplishes its function.

The body gear 520 may have a configuration such as a gear, a cam, a connecting rod, etc. to transmit the driving power from the driving source 510 to the developing agent container 400. For example, the body gear 520 may be installed in one part of the container accommodating part 110. When the developing agent container 400 is accommodated in the container accommodating part 110, the body gear 520 and the container gear 441 engagingly interlock with each other. Thus, a driving power from the driving source 510 is transmitted to the container gear 441 via the body gear 520. The body gear 520 may be modified variously in configuration as long as it accomplishes its function.

The detecting member 600 is preferably installed in the developing agent container 400. The detecting member 600 may generate a sensing signal by sensing a remaining amount of the developing agent T in the developing agent container 400 and transmit the sensing signal to the controller 700. The detecting member 600 may have various technologies so as to detect the remaining amount of the developing agent T.

For example, the detecting member 600 may be provided as a piezo-sensor installed in a lower part of the container casing 410 to sense a load of a developing agent T on the detecting member 600. Alternatively, the detecting member 600 may be provided as a photo-coupler that adopts a light-emitting and light-receiving principle to sense the remaining amount of the developing agent T.

The detecting member 600 may have another configuration that senses electrostatic capacity. Two electrodes may be separately installed within the container casing 410 where a developing agent T is stored, and electrically coupled to each other outside the container casing 410. Accordingly, a developing agent T of a dielectric material is interposed between the two electrodes, which is configured as a form of capacity. When the amount of the developing agent T in the container casing 410 changes, a total amount of electric charge from the capacity also changes, and may be detected by the detecting member 600 and converted into a load of the developing agent T.

The detecting member 600 may have still another configuration where a dot counter is installed in an upper part of the container casing 410 to calculate an amount of a developing agent T using a predetermined algorithm. The detecting member 600 may have various configurations inside or outside the developing agent container 400 as long as it accomplishes its function to detect a remaining amount of a developing agent T.

The detecting member 600 preferably transmits a sensing signal to the controller 700. The detecting member 600 is electrically connected to the container terminal part 430 and transmits a sensing signal to the controller 700 when the developing agent container 400 is mounted to the developing device 300. The detecting member 600 may sense the remaining amount of a developing agent T at a specific time (e.g., at a device condition such as turn-on, periodic, aperiodic, based on commands or user action) or in real time, which is not limited.

The controller 700 may control driving of at least one of the supply unit 440 and the body driver 500, thereby ultimately controlling driving of the supply unit 440. The controller 700 may control the supply unit 440 in various ways. For example, the driving source 510 is turned on and off, or transmission of a driving power is blocked or allowed between the driving source 510 and the body gear 520 to control the supply unit 440.

However, as the developing agent T stored in the developing agent container 400 continually decreases in its remaining amount, a supplying amount of a developing agent T correspondingly gradually decreases as time passes assuming the controller 700 drives the supply unit 440 during the same period of time and at the same speed. When a developing agent T is not uniformly supplied to the developing device 300, a defective image may be formed on a printing medium. Thus, the controller 700 preferably controls driving of the supply unit 440 corresponding to the remaining amount of the developing agent T in the developing agent container 400 to supply a uniform amount of the developing agent T per unit time.

The controller 700 may receive a sensing signal that includes information on a remaining amount of a developing agent T in the developing agent container 400 from the detecting member 600. The controller 700 may increase a driving rate per unit time of the supply unit 440 if the remaining amount of the developing agent T is less than a predetermined level. For example, the controller 700 may increase the driving rate of the supply unit 440 stepwise, intermittently, gradually or the like as the remaining amount of developing agent T in the developing agent container 400 decreases in order to adjust the supplied amount of the developing agent T per unit time to be uniform.

A driving rate of the supply unit 440 may be increased in various ways according to embodiments of the present general inventive concept.

For example, if the controller 700 drives the supply unit 440 on and off for a predetermined unit time for a one time supply of the developing agent T, the ratio of driving time to unit time of the supply unit 440 may be increased according to the remaining amount of the developing agent T in the developing agent container 400 as the remaining amount decreases.

Alternatively, driving speed of the supply unit 440 may be increased while keeping the ratio of driving time to unit time of the supply unit 440 constant. In this case, the driving speed of the supply unit 440 increases according to the remaining amount of the developing agent T in the developing agent container 400 as the remaining amount of the developing agent T decreases.

Figure 4:
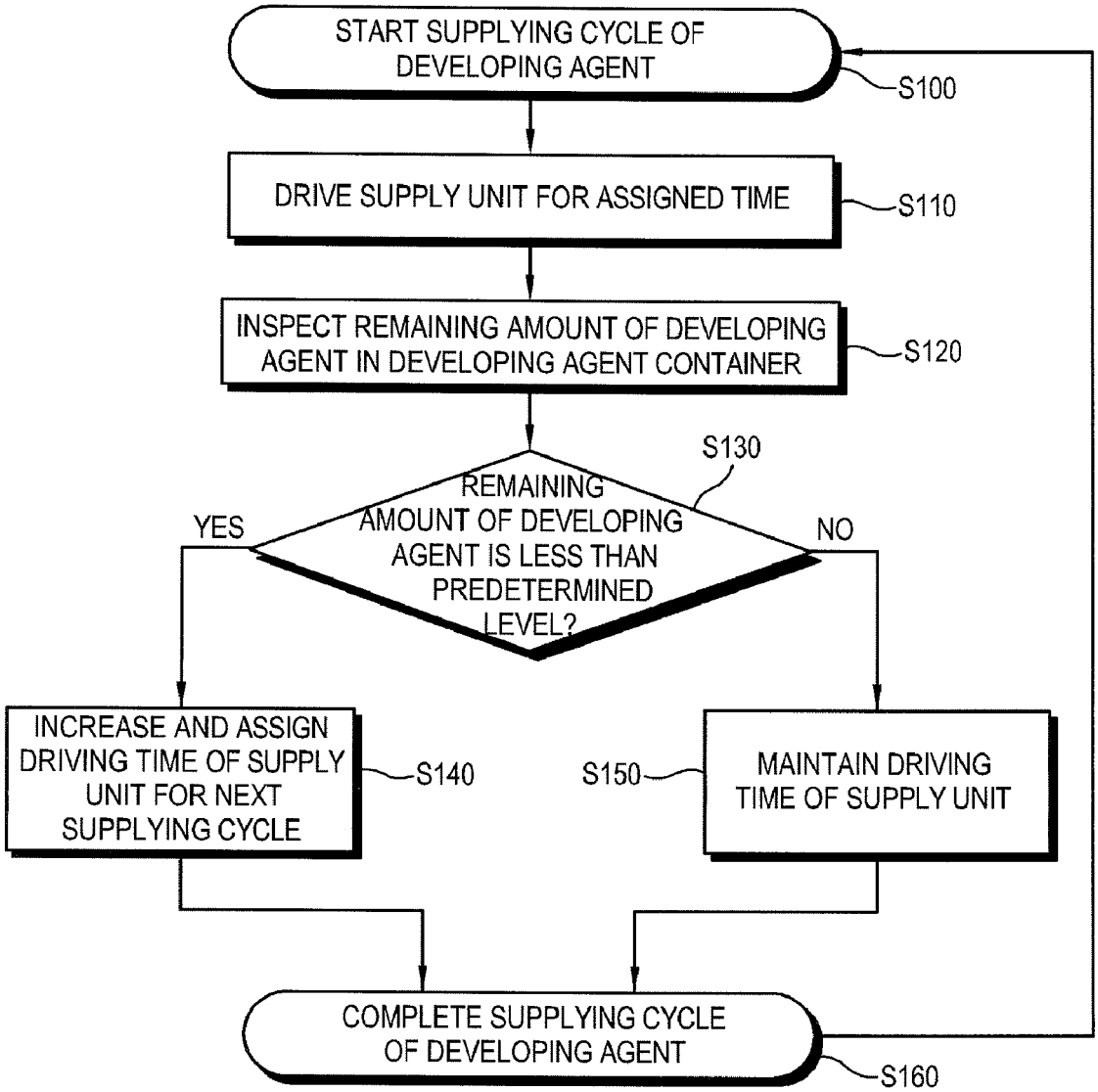
FIG. 4 is a flow chart to illustrate an exemplary embodiment of a process of supplying a developing agent in an image forming apparatus according to the present general inventive concept.

A controlling method of an image forming apparatus according to an embodiment of the present general inventive concept will now be described. As illustrated in FIG. 4, the controlling method embodiment may be used in and will be described using the image forming apparatus 1 of FIGS. 1-3. However, controlling method embodiments for an image forming apparatus and the present general inventive concept are not intended to be so limited. In the controlling method according to the exemplary embodiment of FIG. 4, a driving speed of the supply unit 440 is constant.

The controller 700 turns on and off the supply unit 440 for a predetermined time during a unit time to supply a developing agent T in the developing agent container 400 to the developing device 300. One cycle of supplying the developing agent T may be performed during the unit time and repeated while the image forming apparatus 1 is used.

If the supplying cycle of the developing agent T starts (operation block S100), the controller 700 may drive the supply unit 440 for a predetermined time to provide the developing agent T to the developing device 300 (operation block S110). Here, the remaining amount of the developing agent T in the developing container 400 may be sensed (e.g., detecting member 600) and transmitted to an image forming apparatus controller such as the controller 700 (operation block S120).

The controller 700 may determine whether the remaining amount of the developing agent T transmitted from the detecting member 600 is less than a predetermined level that is preset in the controller 700 (operation block S130). If the remaining amount of the developing agent T is less than the predetermined level, the controller 700 may increase and store the ratio of driving time of the supply unit 440 to the unit time (operation block S140). If the remaining amount of the developing agent T is not less than the predetermined level, the controller 700 does not change the ratio of the driving time to the unit time of the supply unit 440 (operation block S150).

Thus, the one supply cycle of the developing agent T is completed (operation block S160). When a predetermined condition, e.g., a predetermined time passes by, is satisfied, the next cycle to provide the developing agent T may begin (operation block S100).

The controller 700 preferably checks an assigned value of the ratio of the driving time to the unit time of the supply unit 440 before driving the supply unit 440. For example, if the driving time of the supply unit 440 has been assigned to increase in the previous supply cycle of the developing agent T, the controller 700 then drives the supply unit 440 according to the assigned (e.g., increased) value in the current supply cycle of the developing agent T (e.g., operation block S110).

Accordingly, the ratio of the driving time to the unit time of the supply unit 440 may be increased when the remaining amount of the developing agent T in the developing agent container 400 decreases, thereby keeping a supplied amount of the developing agent T during one supply cycle of the developing agent T uniform (e.g., substantially uniform) every cycle.

If the driving time of the supply unit 440 has not been assigned to change in the previous supply cycle of the developing agent T, the controller 700 drives the supply unit 440 in the same driving time ratio as in the previous cycle during the current supply cycle of the developing agent T (e.g., operation block S110).

Embodiments will be described in detail with reference to an experimental data illustrating improved or uniform supply of a developing agent T during a unit time in an image forming apparatus according to the present general inventive concept.

The unit time where one cycle of supplying the developing agent T, for example, is assumed to be four seconds. The supply unit 440 is turned on and off to provide the developing agent T during the unit time (e.g., four seconds). The initial remaining amount of the developing agent T in the developing agent container 400 is given to be 80 g.

In an image forming apparatus, however, efficiency of supplying the developing agent from the developing agent container to the developing device is decreased over time. As an image is repeatedly formed by the image forming apparatus onto a printing medium, a remaining amount of the developing agent in the developing agent container is continually decreased. An amount of the developing agent supplied to the developing device is also gradually continually decreased when a driver in the developing agent container is driven for a predetermined time.

A related art image forming apparatus may detect an amount of a developing agent in a developing device and drive a driver of a developing agent container for a predetermined time if the amount exceeds an allowable range. Accordingly, the developing agent stored in the developing agent container is provided to the developing device.

Figure 5:
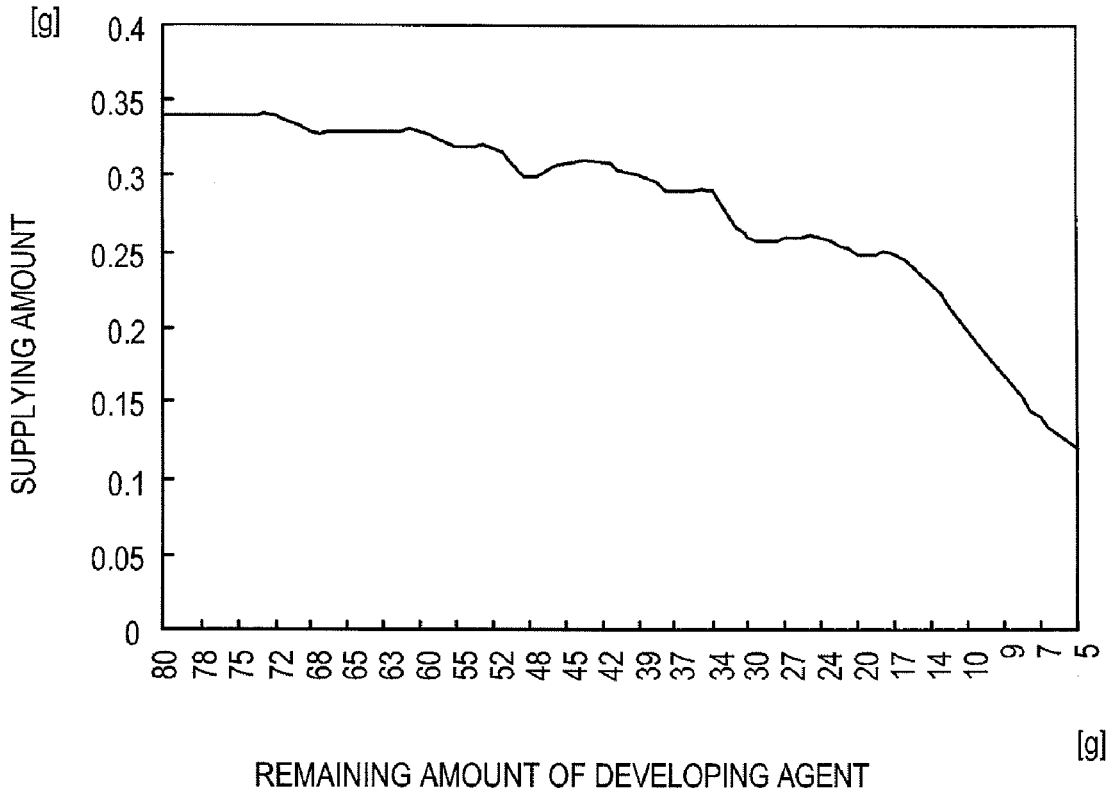
FIG. 5 is a graph to illustrate variation of a supplying amount of a developing agent according to decrease of a remaining amount of the developing agent in a developing agent container in a related art image forming apparatus.

FIG. 5 is a graph to illustrate a supplied amount of the developing agent T per a unit time versus remaining amount of the developing agent T in the developing agent container 400 as the supply cycle is repeated in a related art image forming apparatus. In this example, the supply unit 440 is driven at the same driving speed and for the same driving time during the unit time. As illustrated in FIG. 5, as the remaining amount of the developing agent T decreases, the amount of the developing agent T supplied to the developing device 300 decreases.

Thus, in order to supply a uniform amount of the developing agent T during the unit time, the ratio of the driving time to the unit time of the supply unit 440 may be increased stepwise corresponding to a decrease of the remaining amount of the developing agent T in the developing agent container 400. Increase of the driving time of the supply unit 440 and the supplied amount of the developing agent T according to the decrease of the remaining amount of the developing agent T are illustrated in the following table 1.

TABLE 1

| | Remaining amount of developing agent (g) | | | | | | | | | | | | |
|---|---|---|---|---|---|---|---|---|---|---|---|---|---|
| | 0 | 5 | 8 | 3 | 5 | 8 | 2 | 7 | 0 | 4 | 7 | 0 | |
| Driving time of supply unit (sec) | .0 | .0 | .0 | .5 | .5 | .5 | .5 | .5 | .5 | .0 | .0 | .0 | .0 |
| Suspending time of supply unit (sec) | .0 | .0 | .0 | .5 | .5 | .5 | .5 | .5 | .5 | | | | |
| Supplying amount of developing agent (g) | .34 | .34 | .33 | .35 | .34 | .34 | .33 | .32 | .32 | .33 | .33 | .32 | .31 |

Figure 6:
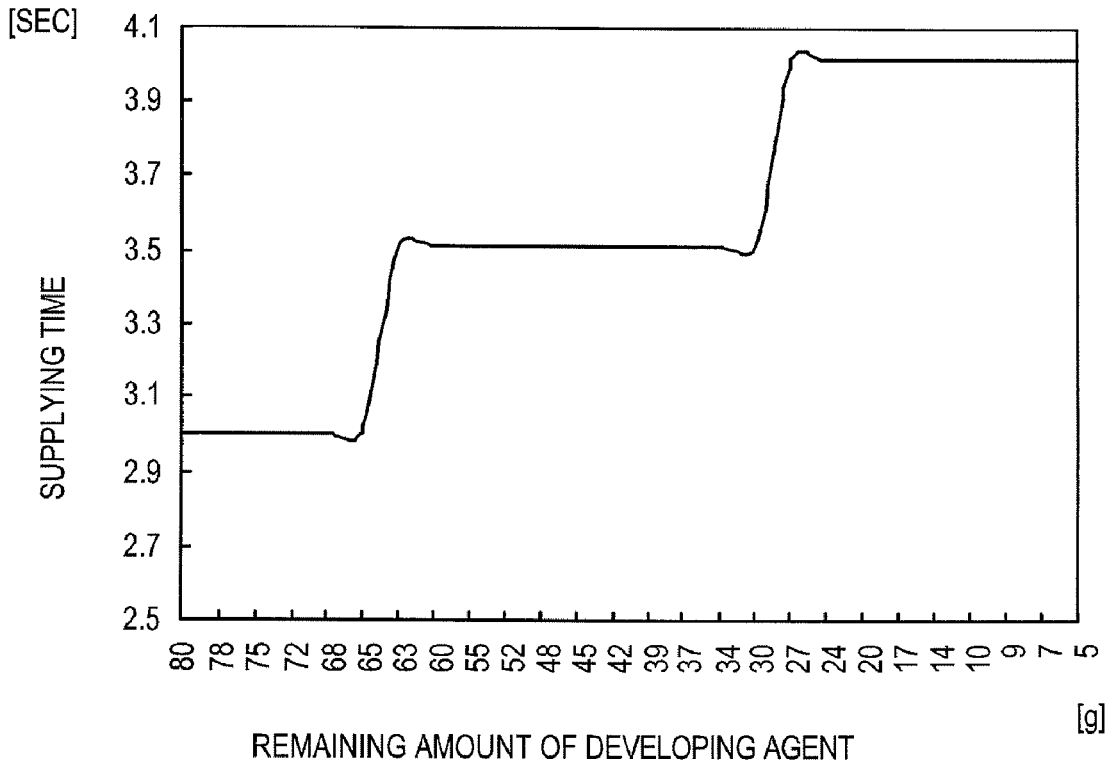
FIG. 6 is a graph to illustrate an exemplary variation of a ratio of a driving time to unit time of a supply unit according to a decrease of a remaining amount of a developing agent in the developing agent container in an image forming apparatus according to an exemplary embodiment of the present general inventive concept.
Figure 7:
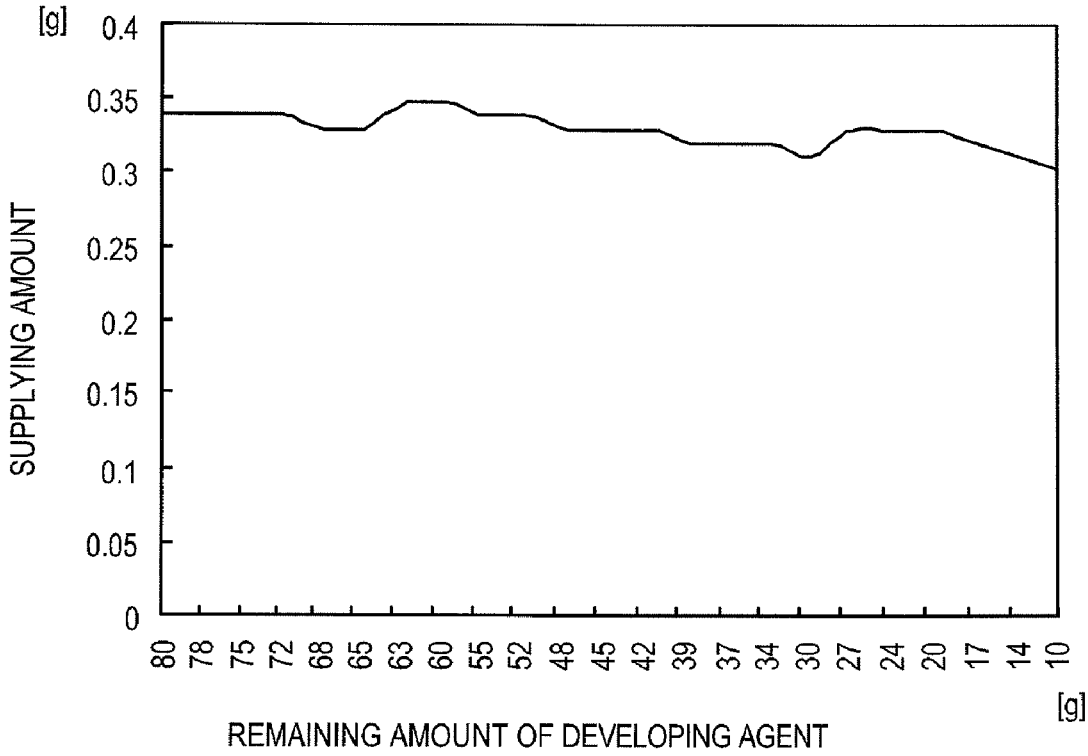
FIG. 7 is a graph to illustrate an exemplary variation of a supplying amount of a developing agent according to a remaining amount of a developing agent in the developing agent container when a supply unit is driven as illustrated in FIG. 6 in an image forming apparatus according to an exemplary embodiment of the present general inventive concept.

FIGS. 6 and 7 illustrate data in Table 1 as a graph. FIG. 6 illustrates variation of the driving time of the supply unit 440 according to variation of the remaining amount of the developing agent T in the developing agent container 400. FIG. 7 is a graph to illustrate variation of amount of the developing agent T supplied from the developing agent container 400 to the developing device 300 when a ratio of the driving time to the unit time of the supply unit 440 is changed as illustrated in FIG. 6.

As illustrated in Table 1 and FIGS. 6 and 7, as the remaining amount of the developing agent T in the developing agent container 400 decreases, the driving time per the unit time of the supply unit 440 increases stepwise from 3.0 seconds to 3.5 seconds and 4.0 seconds. The supplying amount of the developing agent T per the unit time is kept constant at around 0.33 g. The graph in FIG. 5 that does not adopt the present general inventive concept illustrates a significant difference from the graph in FIG. 7, which employs the present general inventive concept.

Similarly, the remaining amount of the developing agent T in the developing agent container 400 may be detected for every supply cycle (or every prescribed (e.g., every third) supply cycle) of the developing agent T, and accordingly the driving rate of the supply unit 440 per the unit time is gradually increased. Thus, the supply cycle of the developing agent T or the supplied amount of the developing agent T to the developing device 300 per the unit time may be kept substantially uniform every time.

Meanwhile, if a new developing agent container is mounted to the developing device 300 as the developing agent T in the developing agent container 400 is exhausted, the controller 700 initializes the driving time of the supply unit 440. For example, the exhausted developing agent container 400 may be replaced with a new developing agent container 400 while 4.0 seconds is assigned as the driving time of the supply unit 440 for the exhausted developing agent container 400 according to the remaining amount of the developing agent T, as illustrated in Table 1. The replaced developing agent container 400 stores 80 g of developing agent T, and accordingly the controller 700 may initialize the driving time of the supply unit 440 to 3.0 seconds. Then, the controller 700 drives the supply unit 440 for 3.0 seconds in a first supplying cycle after the developing agent container 400 is replaced.

In the foregoing exemplary embodiment, a method of stepwise increasing the ratio of the driving time to the unit time of the supply unit 440 was described. However, the remaining amount of the developing agent T in the developing agent container 400 may be detected in real time to gradually increase the driving time of the supply unit 440, which will be described with reference to the aforementioned experimental data.

FIG. 5 illustrates that the supplying amount of the developing agent T to the developing device 300 drastically decreases as the remaining amount of the developing agent T decreases. Provided that an initial driving time of the supply unit 440 is assumed to be 3.0 seconds and an initial amount of the developing agent T in the developing agent container 400 is assumed to be 80 g, the supplied amount of the developing agent T may start to decrease at the time when the remaining amount of the developing agent T is less than 70 g.

Figure 8:
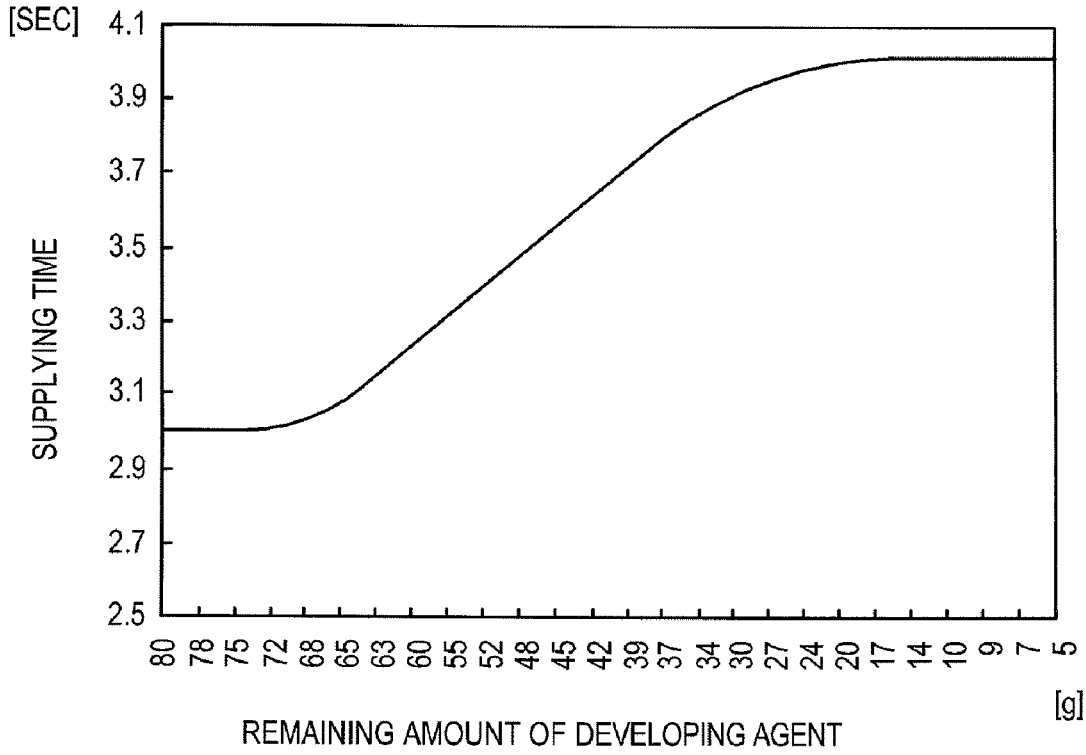
FIG. 8 is a graph to illustrate another exemplary variation of a ratio of a driving time to unit time of a supply unit according to a decrease of a remaining amount of a developing agent in a developing agent container in an image forming apparatus according to an exemplary embodiment of the present general inventive concept.

As illustrated in FIG. 8, the driving time of the supply unit 440 may be kept at 3.0 seconds from the time when the remaining amount of the developing agent T is a full 80 g to the time when the supplying amount of the developing agent T starts to decrease. Here, the detecting member 600 detects the remaining amount of the developing agent T continually, and the driving time of the supply unit 440 is gradually increased corresponding to decrease of the remaining amount of the developing agent T. When the driving time of the supply unit 440 arrives at 4.0 seconds to be equal to the unit time, the driving time of the supply unit 440 is not increased any more. Thus, the driving time of the supply unit 440 per the unit time is gradually increased as illustrated in FIG. 8, and accordingly the supplied amount of the developing agent T to the developing device 300 per the unit time is kept approximately uniform.

When the developing agent container 400 whose developing agent T is exhausted is replaced with the new developing agent container 400, the controller 700 may initialize the driving time of the supply unit 440 per the unit time and control the detecting member 600 to detect the remaining amount of the developing agent T.

The detecting member 600 preferably continually detects the remaining amount of the developing agent T and transmits a detection result to the controller 700. The controller 700 increases the driving time of the supply unit 440 gradually corresponding to the remaining amount of the developing agent T. Such driving time increase rate by the controller 700 is not limited but may have various designs/configurations as long as it accomplishes its function. In one embodiment, a supplying throughput to a developing device may be controllably performed (e.g., varying the throughput capability/quantity of a developing agent discharge pipe over time) to maintain a substantially uniform supply rate from a developing agent container to the developing device as a developing agent amount in the developing agent container decreases.

In exemplary apparatuses and methods according to the present general inventive concept, as described above, an amount of a developing agent supplied from a developing agent container to a developing device per a unit time is adjusted to be substantially uniform. Accordingly, forming of a defective image on a printing medium can be reduced or prevented. In addition, reliability of a product may be improved.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to affect such feature, structure, or characteristic in connection with other ones of the embodiments. Furthermore, for ease of understanding, certain method procedures may have been delineated as separate procedures; however, these separately delineated procedures should not be construed as necessarily order dependent in their performance. That is, some procedures may be able to be performed in an alternative ordering, simultaneously, etc.

Although a few embodiments of the present general inventive concept have been illustrated and described, it will be appreciated by those skilled in the art that changes may be made in these embodiments without departing from the principles and spirit of the general inventive concept, the scope of which is defined in the appended claims and their equivalents. As used in this disclosure, the term "preferably" is non-exclusive and means "preferably, but not limited to." Terms in the claims should be given their broadest interpretation consistent with the general inventive concept as set forth in this description. For example, the terms "coupled" and "connect" (and derivations thereof) are used to connote both direct and indirect connections/couplings. As another example, "having" and "including", derivatives thereof and similar transitional terms or phrases are used synonymously with "comprising" (i.e., all are considered "open ended" terms)—only the phrases "consisting of" and "consisting essentially of" should be considered as "close ended". Claims are not intended to be interpreted under 112 sixth paragraph unless the phrase "means for" and an associated function appear in a claim and the claim fails to recite sufficient structure to perform such function.

What is claimed is:

1. An image forming apparatus comprising:

a developing device to provide a developing agent to an image carrier;

a developing agent container to store the developing agent and comprises a supply unit to provide the stored developing agent to the developing device;

a detecting member disposed in the developing agent container to detect a remaining amount of the developing agent in the developing agent container; and a controller to increase a driving rate of the supply unit stepwise or gradually as the remaining amount of the developing agent becomes lower, wherein the developing agent container is separately located from the developing device and detachably coupled to the image forming apparatus.

2. The image forming apparatus according to claim 1, wherein the driving rate is a driving time of the supply unit over a unit time.

3. The image forming apparatus according to claim 1, wherein the driving rate is a driving speed of the supply unit.

4. A controlling method of a supply unit of a developing agent container, the method being applied to an image forming apparatus comprising a developing device to provide a developing agent to an image carrier, and the developing agent container storing the developing agent and comprising the supply unit to provide the developing agent to the developing device, the method comprising:

detecting a remaining amount of the developing agent in the developing agent container via a detecting member disposed inside the developing agent container; and increasing a driving rate of the supply unit stepwise or gradually as the remaining amount of the developing agent becomes lower, wherein the developing agent container is separately located from the developing device and detachably coupled to the image forming apparatus.

5. The controlling method according to claim 4, wherein the driving rate is a driving time of the supply unit over a unit time.

6. The controlling method according to claim 4, wherein the driving rate is a driving speed of the supply unit.

7. A controlling method of an image forming apparatus which comprises a developing device to provide a developing agent to an image carrier, and a developing agent container which stores the developing agent and comprises a supply unit to provide the developing agent to the developing device, the method comprising:

detecting a remaining amount of the developing agent in the developing agent container via a detecting member disposed inside the developing agent container; and increasing a driving rate of the supply unit stepwise or gradually as the remaining amount of the developing agent becomes lower, wherein the developing agent container is separately located from the developing device and detachably coupled to the image forming apparatus.

8. The controlling method according to claim 7, wherein the driving rate is a driving time of the supply unit over a unit time.

9. The controlling method according to claim 7, wherein the driving rate is a driving speed of the supply unit.

10. The method according to claim 4, wherein the driving rate is between 0.5 and 1.0.

11. An image forming apparatus comprising:

a developing device to provide a developing agent to an image carrier to form an image;

a developing agent container to store the developing agent and to provide the stored developing agent to the developing device; and a controller responsive to a sensing signal output from a detecting member disposed in the developing agent container to control a supply rate among a plurality of different supply rates such that a supplied amount of the stored developing agent to the developing device is substantially uniform during a unit time when the stored developing agent is provided to the developing device from the developing agent container; and a supply unit disposed in the developing agent container, wherein the control increases a driving rate of the supply unit stepwise or gradually as the remaining amount of the developing agent becomes lower, and wherein the developing agent container is separately located from the developing device and detachably coupled to the image forming apparatus.

12. The image forming apparatus according to claim 11, wherein the driving rate is at least one of a driving time of the supply unit over the unit time and a driving speed of the supply unit.

13. The image forming apparatus according to claim 11, wherein the developing device comprises:

a developing roller to convey the developing agent from the developing device to the image carrier; and a container docking part to receive the developing agent container.

14. A developing agent container usable with an image forming apparatus, comprising:

a container casing to contain stored developing agent;

a container docking part coupled to the container casing to output the stored developing agent;

a detecting member to detect a remaining amount of the stored developing agent in the container casing; and a supply unit that operates at plurality of driving rates to provide the stored developing agent at a plurality of different supply rates to the container docking part, the supply unit to operate at an increased driving rate when the remaining amount of the stored developing agent in the container casing is less than a prescribed amount, wherein the developing agent container is separately located from the developing device and detachably coupled to the image forming apparatus, wherein the driving rate of the supply device is configured to increase stepwise or gradually as the remaining amount of the developing agent in the container casing is reduced below the prescribed amount, and wherein the driving rate is a at least one of a driving time of the supply unit over a unit time and a driving speed of the supply unit.

15. The developing agent container according to claim 14, wherein the supply unit is configured to provide the stored developing agent to the container docking part at a substantially uniform rate as the remaining amount of the stored developing agent is reduced from an initial level.

16. The developing agent container according to claim 15, wherein the supply unit is configured to provide the stored developing agent to the container docking part at the substantially uniform rate as the remaining amount of the stored developing agent amount is reduced below half an initial amount or a quarter of the initial amount of the stored developing agent in the container casing.

17. The developing agent container according to claim 14, wherein the supply unit comprises a developing agent moving device to provide the stored developing agent to a docking discharge unit in the container docking part.

* * * * *